United States Patent [19]

Zaks

[11] 4,184,349

[45] Jan. 22, 1980

[54] DOOR WITH MAGNETICALLY CONTROLLED LOCK

[76] Inventor: Nathan Zaks, 540-4 Main St., Roosevelt Island, N.Y. 10044

[21] Appl. No.: 882,092

[22] Filed: Mar. 1, 1978

[51] Int. Cl.[2] ..... E05B 63/14

[52] U.S. Cl. ..... 70/118; 70/276; 70/DIG. 10; 292/39

[58] Field of Search ..... 70/113, 114, 116, 118, 70/120, 275, 276, 277, 279, 280, DIG. 10, DIG. 46; 292/39, 36, 144, 33

[56] References Cited

U.S. PATENT DOCUMENTS

| | | | |
|---|---|---|---|
| 199,255 | 1/1878 | Bone | 292/144 |
| 768,418 | 8/1904 | Adams | 292/36 |
| 1,633,173 | 6/1927 | Freedman et al. | 70/118 |
| 3,581,030 | 5/1971 | Sedley | 70/276 |
| 3,975,934 | 8/1976 | Babai et al. | 70/120 |
| 4,046,410 | 9/1977 | Connell | 292/36 |

*Primary Examiner*—Kenneth Dorner
*Attorney, Agent, or Firm*—Roy C. Hopgood; John M. Calimafde; Charles W. Neill

[57] ABSTRACT

This is a burglar-proof door for apartments or houses and it is held closed by bolts extending from within the door and into sockets in the frame that surrounds the door. The door has hinges, but in the preferred construction there are four bolts, one on each edge of the door so that the door cannot be opened by removal of the pins from the hinges. An electric motor operates, when a magnetically-coded card is inserted in a slot in the outside of the door, to lock or unlock the door when a handle is turned one way or the other. When there is a serious fire in the apartment or the house, a thermostat causes the door to unlock automatically.

7 Claims, 7 Drawing Figures

DOOR WITH MAGNETICALLY CONTROLLED LOCK

BACKGROUND AMD SUMMARY OF THE INVENTION

Doors do not provide adequate protection against burglars if a lock can be forced or broken by prying the door open in the vicinity of the lock. This invention provides an ordinary apartment or house door with bolts that extend from different edges of the door, and from all edges in the preferred construction, so that the door cannot be opened even though the pins on the hinges are removed and even though tools are used to pry the edge of the door at the edge which is remote from the hinges. Prying the door along other edges does not have any effect on making the door swing on its hinges.

It is a common practice to have multiple bolts on the doors of bank vaults, but these are extremely complicated and expensive doors and completely unsuitable for use in an apartment or a house. This invention provides multiple bolts and it is difficult to operate multiple bolts without substantial mechanical advantage. Theoretically, the door knob might have a crank which could be rotated to turn gearing in order to gain the mechanical advantage manually; but it is more practical to utilize a small electric motor and to obtain the mechanical advantage by gearing. In order to obtain a simple and relatively inexpensive mechanism, the door is hollow and has the bolts which project from the edges of the door connected within the door to four arms which are disposed at 90° to one another. These arms are connected with a common hub, a portion of which is a segment of a gear and meshes with a driving gear at one end of a transmission which reduces speed and increases power of a motor connected with the other end of the transmission. The hub also has cam mechanism for operating a switch to stop the motor when the bolts complete their movement into projected or retracted positions. Rotating a door knob or other switch will operate the motor in a direction to lock the door; but the door cannot be unlocked without operating another swtich which can be controlled by a key; but is preferably controlled by a coded magnetic card, such as used by many of the banks for dispensing limited sums of money to depositors when the bank is closed. The slot or keyhole of this key switch is accessible from outside the door, but the door can be opened from the inside by another swtich which bypasses the key switch.

Another feature of the invention provides for automatic unlocking of the door in the event that the apartment or house catches fire and the inside switch for unlocking the door may not be accessible to occupants of the apartment or house. This safety fire switch is operated by a thermostat if the room in which it is located becomes hot.

Other objects, features and advantages of the invention will appear or be pointed out as the description proceeds.

BRIEF DESCRIPTION OF DRAWING

In the drawing, forming a part hereof, in which like reference characters indicate corresponding parts in all the views.

DESCRIPTION OF PREFERRED EMBODIMENT

Figure 1:
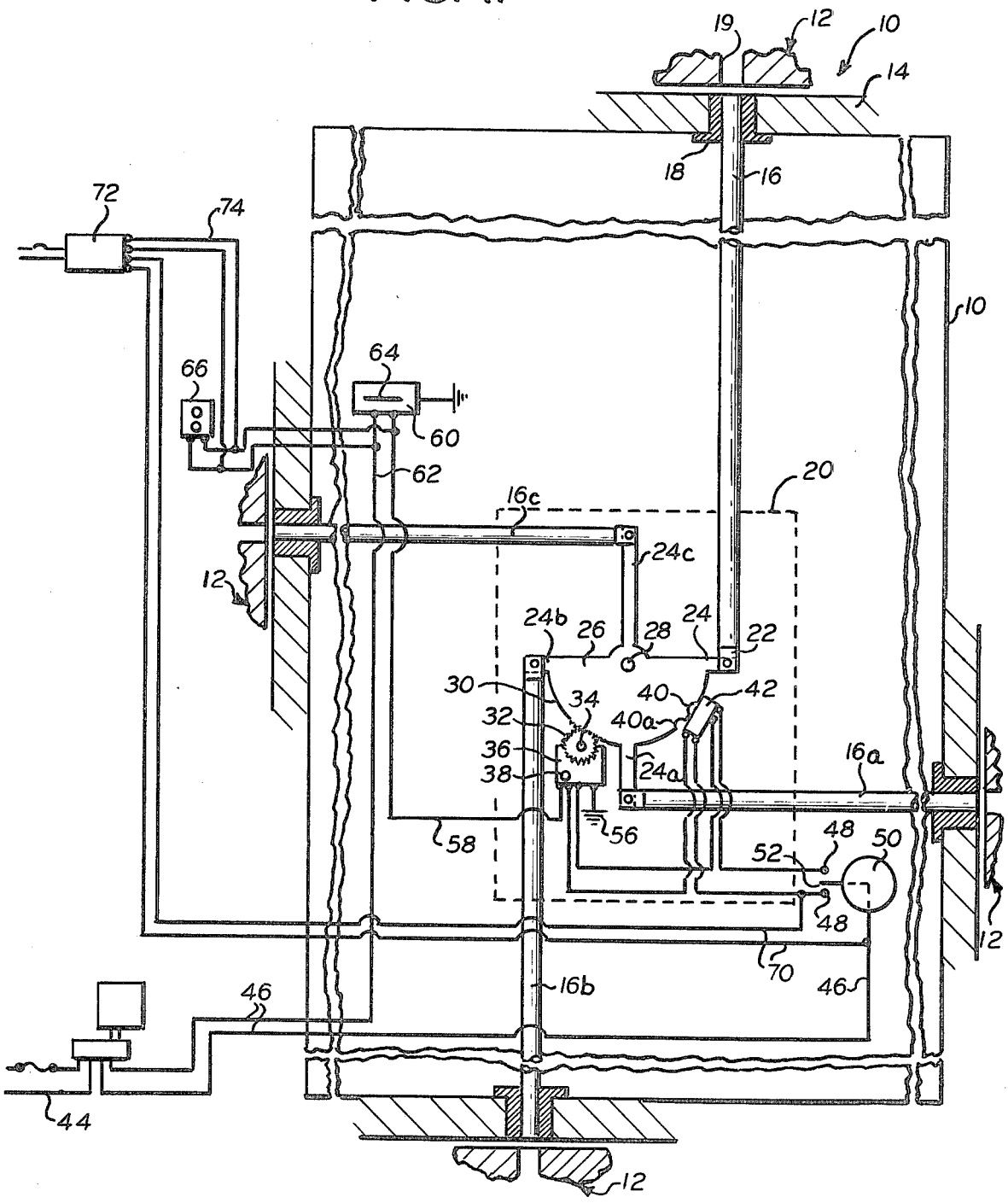
FIG. 1 is a wiring diagram and schematically shows the construction of the door of this invention and the motor and switches by which the bolts of the door are operated, but the structural relation and proportion are shown only by FIGS. 2–7.

FIG. 1 is a diagrammatic view of the invention. A door 10 fits into a door frame 12 when in closed position. The top edge of the door is indicated by the reference chacacter 14, and the interior of the door is hollow. Ordinarily, doors of the type on which this invention is used are steel doors and the edge 14 and the other edges of the door are metal top, bottom and vertical portions of the door. A bolt 16 extends through a bearing 18 in the door edge portion 14. The bolt 16 is shown in retracted position in FIG. 1, where it does not interfere with the opening of the door.

When the door is locked, the bolt 16 protrudes into a socket 19 in the door frame 12. There are similar bolts 16*a*, *b* and *c* which extend from the interior of the door and through edge portions similar to the edge portion 14 and which protude into sockets similar to the socket 19 in the sides and bottom of the door frame 12.

A metal housing or box 20 is inserted into the hollow interior of the door 10; and the bolt 16 projects through the upper wall of the housing 20. At its lower end, the bolt 16 has a fitting 22 which pivotally connects it with an arm 24. The bolts 16*a*, 16*b* and 16*c* are similarly connected with arms 24*a*, 24*b* and 24*c*. These arms are located at 90° to one another corresponding to the 90° spacing between the directions in which the respective bolts 24*a*, 24*b*, and 24*c* move when shifting between locked and unlocked positions.

Figure 7:
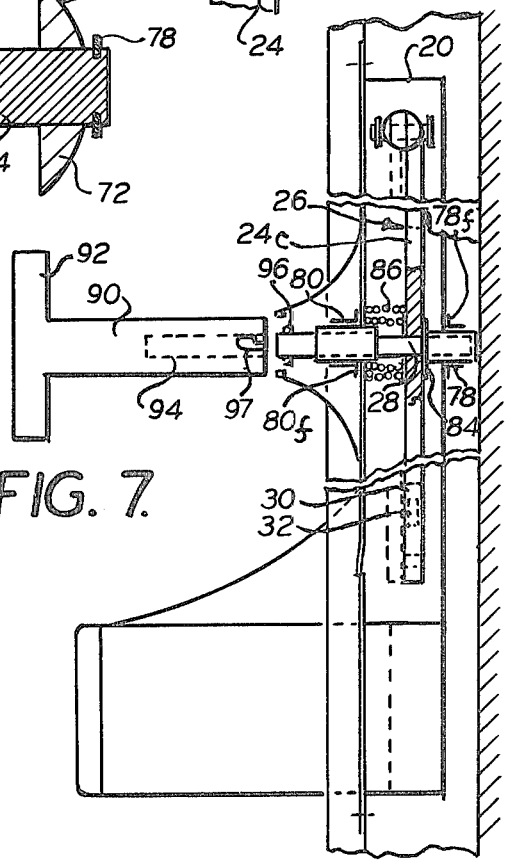
FIG. 7 is a fragmentary, diagrammatic view at right angles to the showing of the door in FIG. 1.

All of the arms 24 (*a*, *b* and *c*) are connected with a common hub 26, and this hub rotates about a shaft 28 which has its oppostie end portions rotatable in bearings which will be shown more fully in FIG. 7.

The lower part of the hub 26 has a circumference of substantial radius with gear teeth 30 along a portion of its circumference. These gear teeth 30 mesh with the teeth of a driving gear 32 on a driven transmission shaft 34 at the output end of a transmission 36 which is driven by an electric motor 38.

On the right-hand lower quadrant of the gear 32, there is a depression 40 which acts as a cam for operating a snap-action switch 42 secured in a fixed position with respect to a wall of the housing 20. A second depression 40*a*, spaced along the circumference of the hub 26, also operates the switch 42 when the hub has turned through a predetermined angle of rotation.

The switch 42 is a snap-action switch which snaps one way when it reaches the depression 40 and the opposite way when it reaches the depression 40*a*. The increased radius of the hub 26 moves the switch 40 far enough to snap over center when it encounters the next depression. Snap-action double-pole, double-throw switches are well known and no further illustration of the details of the switch 42 is necessary for a complete understanding of this invention.

Power for operating the electric motor 38 is supplied from a power source 44 through conductors 46 to a switch 48 which is rotated by a door knob 50. One of the conductors 46 connects with a contact 52 which is moved by the door knob 50 between upper and lower contacts of the switch 48. When the door knob 50 is turned counterclockwise to bring the contact 52 against the lower switch contact 48, power is supplied to the motor 38 to rotate the motor in a direction to open the lock of the door; and when the door knob 50 is turned in a clockwise direction to bring the contact 52 against an upper contact of the swtich 48, power is supplied to the motor 38 to rotate it in the opposite direction so as to lock the door.

The opposite sides of the switch 48 are connected with different sides of the snap action switch 42 by series connections so that the opening of the switch 42 by movement into the depressions 40 and 40*a* of the hub 26 will break one or the other of the circuits from the switch 48 to the motor 38.

In FIG. 1, the door 10 is shown with the bolts 16 (*a, b,* and *c*) retracted so that the door is unlocked. The hub 26 is at the clockwise limit of its travel, and the switch 42 has its operating element in the depression 40.

When the door is to be locked, the door knob 50 is turned clockwise so that its contact 52 comes against the upper contact of the switch 48, and this supplies power to the snap-action switch 42 to the motor 38 in a direction to reverse the operation of the motor so that it rotates the hub 26 counterclockwise. This counterclockwise movement rocks all of the arms 24 (*a, b, c*) in directions to thrust the bolts 16 (*a, b, c*) into the sockets 18 in the door frame 12 so that the door is locked. By the time this motion has taken place, the operating element of the snap-action switch 42 moves into the depression 40*a* and stops the motor 38.

It will be evident from the wiring diagram in FIG. 1 that the door knob 50 and upper contact of switch 48 rotate the motor in a direction to lock the door, this circuit energizing coils of the motor 38 which are connected with ground potential at the connection 56. It is important, however, that the switch 48 control only one side of the motor circuit when the motor is to be operated to unlock the door. The lower contact 52 of switch 48 leads to coils of the motor 38 which are not connected with the ground 56 and which are grounded through another circuit 58 leading to a control switch 60 which is closed by inserting a coded magnetic card to ground the conductor 58 so that the motor will run in a direction to open the door when the door knob 50 is turned counterclockwise.

Such switches operated by coded magnetic cards are commonly used by a number of banks to permit depositors to obtain limited amounts of cash when the banks are closed; and these switches are available from Schlage Electronics at 1135 E. Arques Ave., Sunnyvale, Calif. 94086 (telephone 408-736-8430).

The conductor 58 is grounded through the switch 60 by another conductor 62 which leads back to the upper conductor 46 of the main power supply line from the power source 44.

The switch 60, or at least the slot 64 through which the coded magnetic card is inserted, is accessible from the outside of the door. It is not necessary to have a card in order to open the door from the inside, because there is a switch 66 which can be moved into two different positions, one of which bypasses the switch 60, so that the motor 38 will run when the door knob is turned in a direction to close the switch 48 against its bottom contact.

The invention has another safety feature by which the door will automatically unlock in the event of fire in the apartment or the house to which the door provides access. This feature is obtained by having a bypass circuit 70 around the switch 48; and this bypass or shunt circuit 70 leads to a thermostatically-operated switch 72 which closes to complete another shunt circuit 74 which bypasses the coded magnetic card switch 60.

Figure 2:
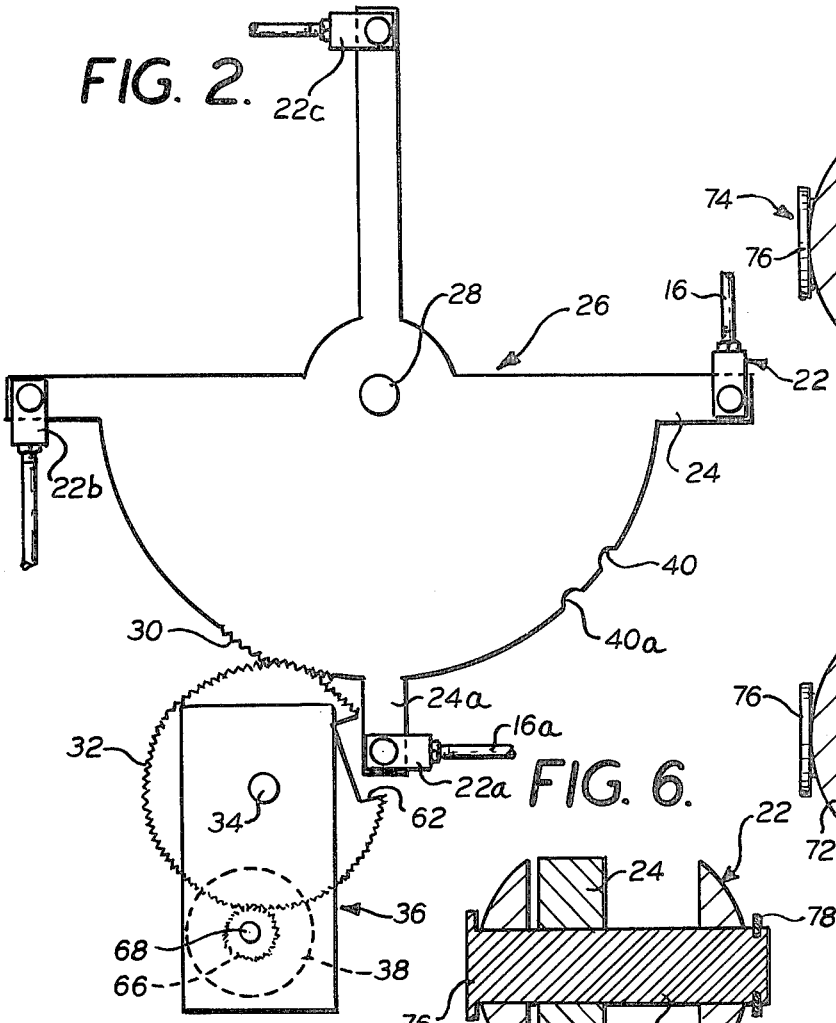
FIG. 2 is an enlarged view showing the preferred correlation of the central hub and its driving mechanism, the structure shown being somewhat different from FIG. 1 where parts were shown diagrammatically for clearer illustration.
Figure 4:
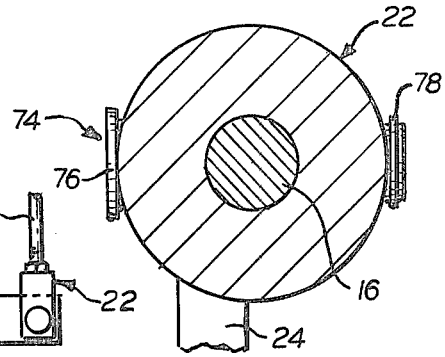
FIGS. 4–6 are sectional views taken on the lines 4—4, 5—5 and 6—6, respectively, of FIG. 3.

FIG. 2 shows the preferred correlation of parts which were shown diagrammatically in FIG. 1. The gear teeth 30 start near the juncture of the arm 24*a* with the hub 26. In order to locate the gear 32 closer to the retracted position of the arm 24*a*, there is a cut-out section 62 in the circumference of the gear 32 to provide clearance for the lower part of the arm 24*a* and a fitting 22*a* by which the arm 24*a* is connected with the bolt 16*a*.

FIG. 2 shows the transmission 36 with a pinion gear 66 attached to a shaft 68 of the motor 38; and this gear 66 meshes with the gear 32 that drives the hub 26. If a smaller or higher speed motor is desired, the transmission 36 can be constructed with a longer gear train for greater mechanical advantage in accordance with conventional practice.

Figure 3:
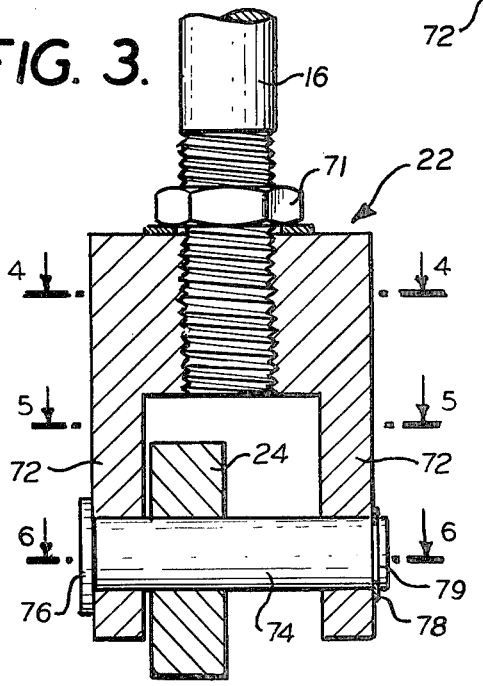
FIG. 3 is an enlarged sectional view showing the fitting for connecting the bolts with the arms of the central hub shown in FIG. 2.

FIG. 3 shows the way in which the bolt 16 is connected to the arm 24 by a fitting 22. A similar fitting connects each of the bolts 16 (*a, b* and *c*) which are similarly connected with their respective arms 24 (*a, b* and c) by similar fittings.

The lower end of the bolt 16 is threaded to screw into the upper portion of the fitting 22 and there is a lock nut 71 on the threads for locking the bolt 16 to the fitting 22.

Figure 5:
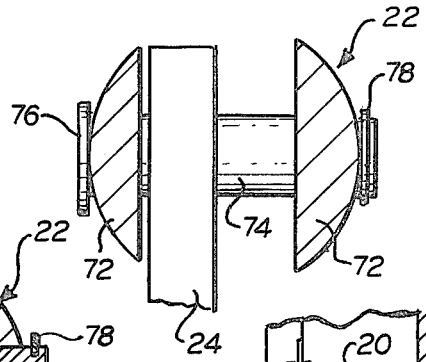
Figure 6:
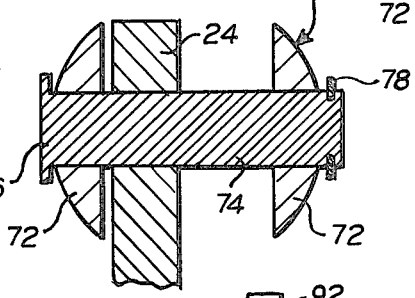

The lower end of the fitting 22 is bifurcated, as shown in FIGS. 3, 5 and 6. The bifurcations are indicated by the reference characters 72. A pin 74 extends through the bifurcations 72 and across the space between the bifurcations. This space is more than twice the thickness of the arm 24 for reasons which will be explained in connection with FIG. 7. The pin 74 is held against axial movement by a head 76 at one end and a snap ring 78 which fits into a groove 79 at the other end of the pin 74, as shown in FIG. 3.

Each of the fittings 22 connects its bolt 16 to the hub 26 so that the bolts 16 extend in directions substantially tangent to the circle along which the pins 74 move when the hub 26 is rotated to lock or unlock the door. The pins 74 move through such a short angle of arc and are so far removed from the bearings 18 (FIG. 1) in which the bolts 16 slide, that there is substantially no change in the direction of the axes of the bolts between the locked and unlocked position of the bolts. There is enough clearance between the bolt 16 and its bearing 18 to accommodate whatever change in angle does occur.

FIG. 7 is a fragmentary sectional view through the door structure, the section being taken through the axis of the shaft 28. This view is schematic, and for the purpose of showing how the arms 24 move lengthwise along the pins 74, in order to disengage the teeth 30 on the hub 26 from the gear 32. The hub 26 rotates on the shaft 28. This shaft is supported in bearings 78 and 80 which are connected to front and back walls of the housing 20 by flanges 78*f* and 80*f*. The shaft 28 is movable axially in these bearings 78 and 80. A flange 84 is secured to the shaft 28. A coil spring 86 is compressed between the hub 26 and a wall of the housing 20. The pressure of this compression spring 86 urges the hub 26 toward the left in FIG. 7 and pushes the flange 84 into contact with the end of the bearing 78 which is fixed to the front wall of the housing 20.

A key 90 has a knob 92 by which it can be rotated. A stem of the key 90 has an end portion with a bore 94 which telescopes over the left-hand end of the shaft 28. There are pins 96 projecting from the circumference of the shaft 28.

Bayonet slots 97 extending through the circumference of the key 90 and communicating with the bore 94, are wide enough to slide over the pins 96 so that when the key 90 is turned to bring the pins 96 into the recesses of the bayonet slot 97, the shaft 28 can be pulled manually by the key 90 against the pressure of the spring 86 so as to shift the hub 26 to the right in FIG. 7 and thereby disengage the teeth 30 of the hub from the teeth of the gear 32. This permits the hub 26 to operate the bolts independently of the motor which drives the gear 32.

The end of the shaft 28 over which the key 90 telescopes is at the inside of the door. By placing the sleeve portion of the key 90 over the pins 96 and pulling the shaft 28 and hub 26 to the left in FIG. 7, the teeth on the hub 26 disengage from the gear 32 and the knob 92 can be turned in opposite directions to lock and unlock, respectively, the bolts 16 (FIG. 1). The removable knob 92 is not the same as the knob 50 (FIG. 1) which operates the switch 48 for opening and locking the door by means of the electrical controls. By disengaging the hub 26 from the motor, the knob 92 makes it possible to open the door even though there is no electric power available.

The preferred embodiment of the invention has been illustrated and described, but changes and modifications can be made and some features can be used in different combinations without departing from the invention as defined in the claims.

What is claimed is:

1. Door bolting mechanism including a door that swings from open position into a closed position where the top, bottom, and sides of the door fit into a frame to close the door, the frame having a socket for receiving a locking bolt, characterized by the door having a hollow portion, a hub within the hollow portion, bearings by which the hub is supported in said hollow portion for rotation about an axis extending substantially normal to a front surface of the door, a bolt connected with the hub by a pivot connection with a radius of the hub extending substantially at right angles to the longitudinal axis of the bolt at said pivot connection, a motor associated with the hub, motion-transmitting connections through which the motor rotates the hub, and a key device for operating the motor to turn the hub in a direction to move the bolt axially with respect to said socket, characterized by the door having a plurality of bolts that are displaced from the door and into sockets adjacent to the frame, fittings connecting the inner ends of the bolts with the hub at locations where the direction of the longitudinal axes of the bolts extend substantially tangent to an arc of movement of the connection of the fitting to the hub, characterized by the hub having a separate arm for each bolt, a circumferential section on the hub between the angular positions of successive arms and with gear teeth thereon, a gear driven by the motor and meshing with the teeth on said circumferential section, and further characterized by the circumferential section on the hub and the gear being located near the end of one of the arms of the hub, the gear having a circumference large enough to operate the bolts with less than one turn of the gear, and a cut-out portion of the circumference of the gear in position to provide clearance for the adjacent arm for a hub position corresponding to one limit of the movement of the hub.

2. Door bolting mechanism including a door that swings from open position into a closed position where the top, bottom, and sides of the door fit into a frame to close the door, the frame having a socket for receiving a locking bolt, characterized by the door having a hollow portion, a hub within the hollow portion, bearings by which the hub is supported in said hollow portion rotation about an axis extending substantially normal to a front surface of the door, a bolt connected with the hub by a pivot connection with a radius of the hub extending substantially at right angles to the longitudinal axis of the bolt at said pivot connection, a motor associated with the hub, motion-transmitting connections through which the motor rotates the hub, and a key device for operating the motor to turn the hub in a direction to move the bolt axially with respect to said socket, characterized by a gear driven by the motor for imparting angular movement to the hub, means for causing relative movement of the hub and gear in a direction parallel to the axis of rotation of the hub and gear for a distance greater than the width of the gear teeth whereby the hub is disconnected from the gear and the motor.

3. Door bolting mechanism including a door that swings from open position into a closed position where the top, bottom, and sides of the door fit into a frame to close the door, the frame having a socket for receiving a locking bolt, characterized by the door having a hollow portion, a hub within the hollow portion, bearings by which the hub is supported in said hollow portion for rotation about an axis extending substantially normal to a front surface of the door, a bolt connected with the hub by a pivot connection with a radius of the hub extending substantially at right angles to the longitudinal axis of the bolt at said pivot connection, a motor associated with the hub, motion-transmitting connections through which the motor rotates the hub, and a key device for operating the motor to turn the hub in a direction to move the bolt axially with respect to said socket, characterized by a power-control switch for the motor and means for operating the switch in accordance with the angular displacement of the hub to provide an automatic stop for the movement of the bolt.

4. Door bolting melchanism including a door that swings from open position into a closed position where the top, bottom, and sides of the door fit into a frame to close the door, the frame having a socket for receiving a locking bolt, characterized by the door having a hollow portion, a hub within the hollow portion, bearings by which the hub is supported in said hollow portion for rotation about an axis extending substantially normal to a front surface of the door, a bolt connected with the hub by a pivot connection with a radius of the hub extending substantially at right angles to the longitudinal axis of the bolt at said pivot connection, a motor associated with the hub, motion-transmitting connections through which the motor rotates the hub, and a key device for operating the motor to turn the hub in a direction to move the bolt axially with respect to said socket, characterized by the connection of the bolt to the hub including a threaded portion with the longitudinal axis of the threaded portion extending in the direction of the axis of the bolt so that rotation of the bolt in the threaded portion lengthens or shortens the projection of the bolt beyond the door for a predetermined movement of the hub.

5. The door bolting mechanism described in claim 4 characterized by the door having a plurality of bolts that are displaced from the door and into sockets adjacent to the frame, fittings connecting the inner ends of the bolts with the hub with the fittings connected to the hub at locations substantially along a longitudinal axis of the bolt which intersects a radius of the hub at an angle of substantially 90°, each of the bolts being individually adjustable in said threaded portion, and means for locking each individual bolt in position to maintain the relative adjustments of the separate bolts with respect to one another.

6. Door bolting mechanism including a door that swings from open position into a closed position where the top, bottom, and sides of the door fit into a frame to close the door, the frame having a socket for receiving a locking bolt, characterized by the door having a hollow portion, a hub within the hollow portion, bearings by which the hub is supported in said hollow portion for rotation about an axis extending substantially normal to a front surface of the door, a bolt connected with the hub by a pivot connection with a radius of the hub extending substantially at right angles to the longitudinal axis of the bolt at said pivot connection, a motor associated with the hub, motion-transmitting connections through which the motor rotates the hub, and a key device for operating the motor to turn the hub in a direction to move the bolt axially with respect to said socket, characterized by a heat-responsive switch for unlocking the door in the event of a fire within an enclosure to which the door provides access.

7. Door bolting mechanism including a door that swings from open position into a closed position where the top, bottom, and sides of the door fit into a frame to close the door, the frame having a socket for receiving a locking bolt, characterized by the door having a hollow portion, a hub within the hollow portion, bearings by which the hub is supported in said hollow portion for rotation about an axis extending substantially normal to a front surface of the door, a bolt connected with with the hub by a pivot connection with a radius of the hub extending substantially at right angles to the longitudinal axis of the bolt at said pivot connection, a motor associated with the hub, motion-transmitting connections through which the motor rotates the hub, and a key device for operating the motor to turn the hub in a direction to move the bolt axially with respect to said socket, characterized by the motor being within the door, switches for supplying power to the motor to move the bolt, said switches including one that is operated by insertion of a coded magnetic card into proximity with the switch, a plurality of other bolts that are displaced from the door and into sockets adjacent to the frame, fittings connecting the inner ends of the bolts with the hub, the fittings being connected with the hub at locations where the longitudinal axis of each fittng is at substantially right angles to the radius of the hub, bearings in the door adjacent to the ends of the bolts that extend into sockets in the door frame, said bearings having enough clearance around the bolts to compensate for any change in the direction of the axis of the bolts resulting from angular movement of the connection of each bolt with the hub, a power-control switch for the motor, and means for operating the switch in accordance with the displacement of the hub to provide an automatic stop for the movement of the bolts, the hub having a separate arm for each bolt, a circumferential section of the hub between the angular positions of successive arms and gear teeth on said circumferential section, a gear driven by the motor and meshing with the teeth on the circumferential section, said section on the hub and said gear being located near the end of one of the arms of the hub, the gear having a circumference large enough to operate the bolts with less than one turn of the gear, and a cut-out portion of the circumference of the gear in position to provide clearance for the adjacent arm of the hub when the parts are in a position corresponding to one limit of their movement.

* * * * *